US010897110B2

(12) United States Patent
van Beek et al.

(10) Patent No.: US 10,897,110 B2
(45) Date of Patent: Jan. 19, 2021

(54) HYBRID CONNECTOR FOR HIGH SPEED WIRELINE COMMUNICATION

(71) Applicant: NXP B.V., Eindhoven (NL)

(72) Inventors: Jozef Thomas Martinus van Beek, Rosmalen (NL); Kim Phan Le, Eindhoven (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/214,657

(22) Filed: Dec. 10, 2018

(65) Prior Publication Data

US 2020/0185869 A1 Jun. 11, 2020

(51) Int. Cl.

| | |
|---|---|
| ***H01R 24/54*** | (2011.01) |
| ***H01Q 1/12*** | (2006.01) |
| ***H01Q 1/38*** | (2006.01) |
| ***H01R 24/50*** | (2011.01) |
| ***H01R 24/56*** | (2011.01) |

(52) U.S. Cl.

CPC ..... *H01R 24/542* (2013.01); *H01Q 1/1207* (2013.01); *H01Q 1/38* (2013.01); *H01R 24/50* (2013.01); *H01R 24/568* (2013.01); *H01R 2201/02* (2013.01)

(58) Field of Classification Search

CPC ..... H01Q 1/243; H01Q 1/385137; H01Q 1/1207; H04B 10/2507; H04B 10/02; H01R 24/542; H01R 24/568; H01R 24/50

USPC ..... 439/578

See application file for complete search history.

(56) References Cited

U.S. PATENT DOCUMENTS

| | | | | |
|---|---|---|---|---|
| 5,302,922 | A * | 4/1994 | Heidemann | H04B 10/25137 333/164 |
| 5,378,937 | A * | 1/1995 | Heidemann | H04B 10/2507 327/306 |
| 9,107,027 | B2 | 8/2015 | Sudak | |
| 9,270,341 | B2 | 2/2016 | Vaucher | |
| 9,997,844 | B2 * | 6/2018 | Lilja | H01Q 1/243 |
| 10,649,585 | B1 | 5/2020 | Van Beek et al. | |
| 2005/0032413 | A1 | 2/2005 | Tolmie | |

(Continued)

FOREIGN PATENT DOCUMENTS

EP 3 203 287 A1 8/2017

OTHER PUBLICATIONS

H. Lee et al., "An 20-Gb/s W-Band OOK CMOS Receiver for High-Speed Wireless Interconnect", IEEE Microwave and Wireless Components Letters, vol. 26, No. 10, pp. 840-842. (Oct. 2016) (doi: 10.1109/LMWC.2016.2605402).

(Continued)

*Primary Examiner* — Jean F Duverne

(57) ABSTRACT

A hybrid connector for a data cable, including: a galvanic connector having a plurality of connectors configured to make a galvanic connection with a plurality of connectors in a receptacle wherein a first portion of the plurality connectors are power connections and a second portion of the plurality of connectors are data connections; a plurality of millimeter wave wireless transmitter/receivers (TRx) configured to transmit/receive data from/to the hybrid connector; and a plurality of millimeter wave antennas surrounding the galvanic connector each antenna connected to one of the plurality of millimeter wave TRx's, wherein the plurality of millimeter wave antennas are configured to transmit/receive millimeter wave data signals.

32 Claims, 5 Drawing Sheets

(56) References Cited

U.S. PATENT DOCUMENTS

| | | | |
|---|---|---|---|
| 2007/0270017 | A1 | 11/2007 | Hardacker et al. |
| 2011/0009078 | A1 | 1/2011 | Kawamura |
| 2014/0073182 | A1 | 3/2014 | Ardisana, II et al. |
| 2018/0175497 | A1 | 6/2018 | Choi et al. |
| 2020/0185814 | A1 | 6/2020 | Van Beek et al. |

OTHER PUBLICATIONS

"New TransferJet X Standard Archieves 10 Gbps of High Rate, Close Proximity Wireless Communications"; retreived from the internet https://www.digitimes.com/news/a20180620PR200.html on Feb. 24, 2020; 9 pages (Jun. 21, 2018).

* cited by examiner

HYBRID CONNECTOR FOR HIGH SPEED WIRELINE COMMUNICATION

TECHNICAL FIELD

Various exemplary embodiments disclosed herein relate generally to a hybrid connector for high speed wireline communications.

BACKGROUND

Wireline communication is the technology of choice when high data rates need to be transported e.g., for streaming high definition video content. These cables are terminated with connectors that hold a number of pins. The number of pins in large part determines the size and cost of the connector. The number of pins is set by the data rate that is supported. Typically, multiple parallel data lanes are used to communicate data in parallel, each lane carrying a certain maximum data rate. A general trend is that higher and higher data rates need to be supported, and it can therefore be expected that there will be a necessity to further increase the number of pins in future connectors to support these increasing data rates.

SUMMARY

A summary of various exemplary embodiments is presented below. Some simplifications and omissions may be made in the following summary, which is intended to highlight and introduce some aspects of the various exemplary embodiments, but not to limit the scope of the invention. Detailed descriptions of an exemplary embodiment adequate to allow those of ordinary skill in the art to make and use the inventive concepts will follow in later sections.

Various embodiments relate to a hybrid connector for a data cable, including: a galvanic connector having a plurality of connectors configured to make a galvanic connection with a plurality of connectors in a receptacle wherein a first portion of the plurality connectors are power connections and a second portion of the plurality of connectors are data connections; a plurality of millimeter wave wireless transmitter/receivers (TRx) configured to transmit/receive data from/to the hybrid connector; and a plurality of millimeter wave antennas surrounding the galvanic connector each antenna connected to one of the plurality of millimeter wave TRx's, wherein the plurality of millimeter wave antennas are configured to transmit/receive millimeter wave data signals.

Various embodiments are described, wherein the plurality of millimeter wave antennas are configured so that the hybrid connector is flippable.

Various embodiments are described, wherein half of the plurality of millimeter wave antennas have a polarization that is substantially orthogonal to the polarity of the other half of the plurality of millimeter wave antennas.

Various embodiments are described, wherein the plurality of millimeter wave antennas includes eight antennas and four millimeter wave TRx's.

Various embodiments are described, wherein the eight millimeter wave antennas are configured to in pairs surrounding the galvanic connector.

Various embodiments are described, wherein one antenna of each of the antenna pairs is closer to the galvanic connector and the other antenna of each of the antenna pairs if farther from the galvanic connector.

Various embodiments are described, wherein the antennas of each of the antenna pairs are substantially colinear.

Various embodiments are described, wherein the plurality of antennas are side-coupled antennas.

Various embodiments are described, wherein one of the plurality of antennas is one of a Yagi-Uda antenna and a Vivaldi antenna.

Various embodiments are described, wherein the galvanic connector is a USB-C connector.

Various embodiments are described, wherein each of the plurality of TRx's are connected to two of the plurality of a plurality of millimeter wave antennas via a plurality of switches so that the hybrid connector is flippable.

Various embodiments are described, wherein one of the plurality of TRx's modulate a data signal onto the power connections.

Further various embodiments relate to a data cable, including: a first hybrid connector; a second hybrid connector; and plurality of wires connecting the first and second hybrid connectors, wherein each of the first and second hybrid connectors comprise: a galvanic connector having a plurality of connectors configured to make a galvanic connection with a plurality of connectors in a receptacle wherein a first portion of the plurality connectors are power connections and a second portion of the plurality of connectors are data connections; a plurality of millimeter wave wireless transmitter/receivers (TRx) configured to transmit/receive data from/to the hybrid connector; and a plurality of millimeter wave antennas surrounding the galvanic connector each antenna connected to one of the plurality of millimeter wave TRx's, wherein the plurality of millimeter wave antennas are configured to transmit/receive millimeter wave data signals.

Various embodiments are described, wherein the plurality of millimeter wave antennas for each of the first and second hybrid connectors are configured so that the first and second hybrid connectors are flippable.

Various embodiments are described, wherein half of the plurality of millimeter wave antennas for each of the first and second hybrid connectors have a polarization that is substantially orthogonal to the polarity of the other half of the plurality of millimeter wave antennas.

Various embodiments are described, wherein the plurality of millimeter wave antennas for each of the first and second hybrid connectors includes eight antennas and four millimeter wave TRx's.

Various embodiments are described, wherein the eight millimeter wave antennas for each of the first and second hybrid connectors are configured to in pairs surrounding the galvanic connector.

Various embodiments are described, wherein the plurality of antennas are side-coupled antennas.

Various embodiments are described, wherein one of the plurality of antennas is one of a Yagi-Uda antenna and a Vivaldi antenna.

Various embodiments are described, wherein the galvanic connector for each of the first and second hybrid connectors is a USB-C connector.

Further various embodiments relate to a hybrid receptacle configured to receive a hybrid connector of a data cable, including: a galvanic connector having a plurality of connectors configured to make a galvanic connection with a plurality of connectors in the hybrid connector wherein a first portion of the plurality connectors are power connections and a second portion of the plurality of connectors are data connections; a plurality of millimeter wave wireless transmitter/receivers (TRx) configured to transmit/receive data from/to the hybrid receptacle; and a plurality of millimeter wave antennas surrounding the galvanic connector each antenna connected to one of the plurality of millimeter wave TRx's, wherein the plurality of millimeter wave antennas are configured to transmit/receive millimeter wave data signals.

Various embodiments are described, wherein the plurality of millimeter wave antennas are configured so that the hybrid connector is flippable.

Various embodiments are described, wherein half of the plurality of millimeter wave antennas have a polarization that is substantially orthogonal to the polarity of the other half of the plurality of millimeter wave antennas.

Various embodiments are described, wherein the plurality of millimeter wave antennas includes eight antennas and four millimeter wave TRx's.

Various embodiments are described, wherein the eight millimeter wave antennas are configured to in pairs surrounding the galvanic connector.

Various embodiments are described, wherein the plurality of antennas are side-coupled antennas.

Various embodiments are described, wherein one of the plurality of antennas is one of a Yagi-Uda antenna and a Vivaldi antenna.

Various embodiments are described, wherein the galvanic connector is a USB-C connector.

Various embodiments are described, wherein each of the plurality of TRx's are connected to two of the plurality of a plurality of millimeter wave antennas via a plurality of switches so that the hybrid connector is flippable.

Various embodiments are described, wherein one of the plurality of TRx's modulate a data signal onto the power connections.

BRIEF DESCRIPTION OF THE DRAWINGS

In order to better understand various exemplary embodiments, reference is made to the accompanying drawings, wherein.

To facilitate understanding, identical reference numerals have been used to designate elements having substantially the same or similar structure and/or substantially the same or similar function.

DETAILED DESCRIPTION

The description and drawings illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be for pedagogical purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or (i.e., and/or), unless otherwise indicated (e.g., "or else" or "or in the alternative"). Also, the various embodiments described herein are not necessarily mutually exclusive, as some embodiments can be combined with one or more other embodiments to form new embodiments.

Figure 1:
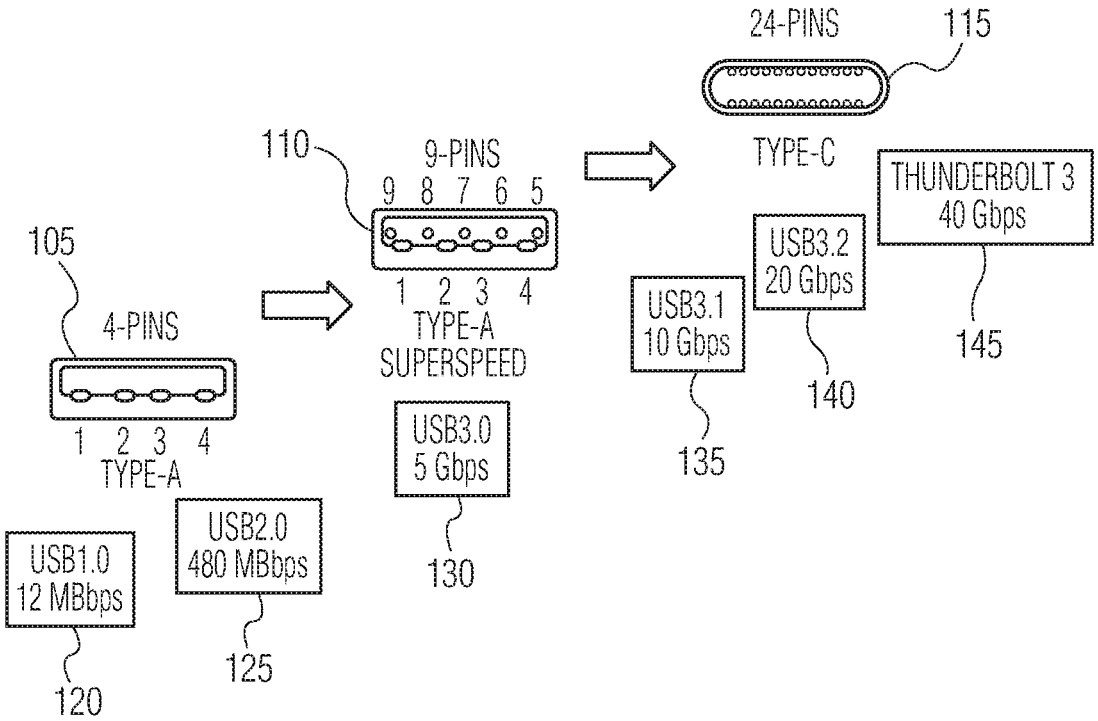
FIG. 1 illustrates the evolution of the USB connector.
Figure 2:
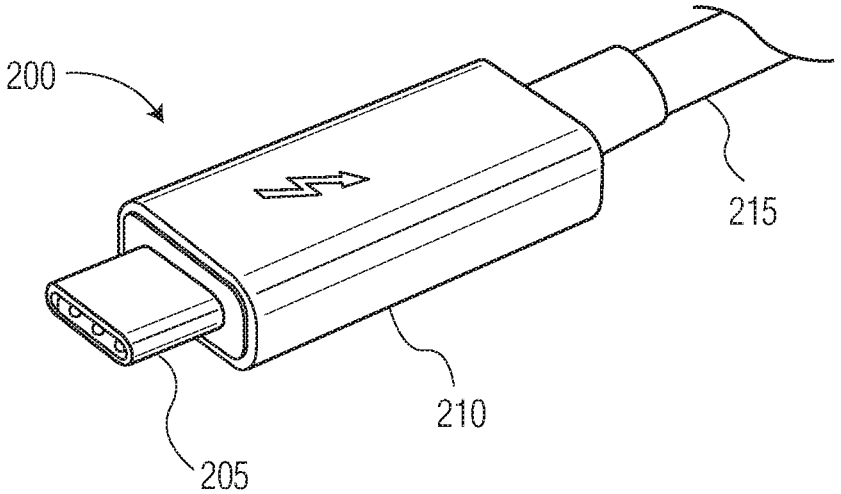
FIG. 2 illustrates a picture of a UCB-C connector.

FIG. 1 illustrates the evolution of the USB connector. FIG. 1 also illustrates the trade-off between data rate, connector size, and pinning. From USB type-A 105 to USB type-A superspeed 110 to USB-C 115, the number of pins has been increased from 4 to 24 and data rate has been increased from ~10 Mbps to 40 Gbps (from USB 1.0 120 to USB 2.0 125 to USB 3.0 130 to USB 3.1 135 to USB 3.2 140 to Thunderbolt 3 145). For Thunderbolt 3, supporting 40 Gbps full-duplex data transmission requires that one differential pair can support up to 20 Gbps. So, four differential pairs are required to support 40 Gbps full-duplex mode operation. The other pins in the connector are required to make the connector backward compatible to USB2.0 and for power delivery. Furthermore, some extra pinning is also required to make the connector symmetric so that it may be flipped without losing functionality. FIG. 2 illustrates a picture of a UCB-C connector. The USB-C connector 200 includes a plug 205 that includes the 24 pins on the inside, a housing 210, and the cable 215.

Extending the trend of increasing data rates and smaller connectors will require more and smaller pins residing inside the connector. This will result in a number of issues including: tighter tolerance on assembly which leads to increased manufacturing cost; a fragile connector that may limit the number of mating cycles; sensitivity to dirt and mechanical damage, e.g., caused by someone tripping over the cable; and new standards will not be backward compatible with mechanical layout of existing connectors and ports, such as currently being deployed for USB-C. Therefore, a new connector with increased bandwidth that is backward compatible to USB-C is desirable.

Embodiments of a hybrid connector combining galvanic connections that carry power and data, together with a short range wireless connection to further increase data rates will be described herein. The wireless link will use millimeter wave transmission frequencies because antennas at millimeter wave will easily fit inside the connector, and large available bandwidth allowing for high data rate is available. Further, the short distance between a connector and a receptor results in a high signal to noise ratio (SNR) throughout the channel allowing for a high data rate, and the wireless link does not suffer from line-of-sight issues normally associated with millimeter wave.

Figure 3:
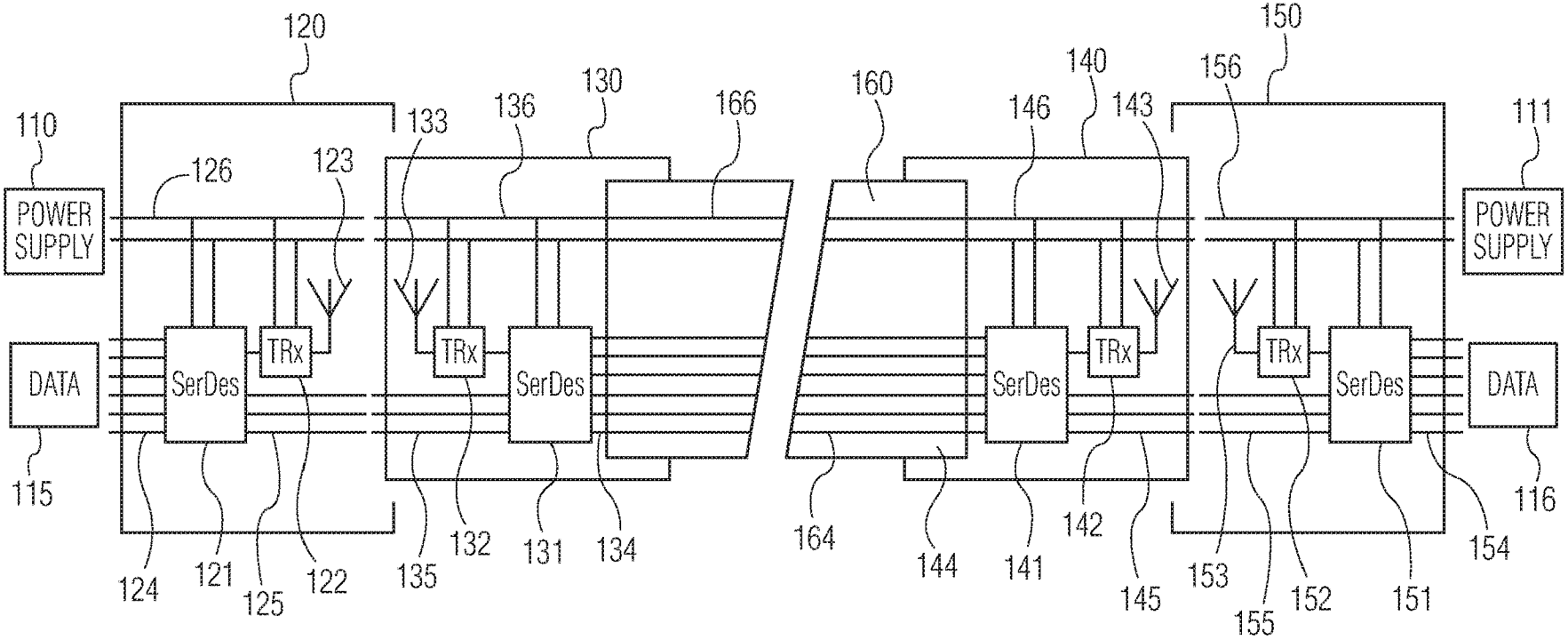
FIG. 3 illustrates a link between two devices using hybrid connectors and receptors.

FIG. 3 illustrates a link between two devices using hybrid connectors and receptors. A first device 120 is connected to a second device 150 using a cable 160 having hybrid connectors 130 and 140. The first device receives/transmits input/output data 115 and power 110. Likewise, the second device receives/transmits input/output data 116 and power 111. The first device includes a serializer/deserializer (SerDes) 121 that the receives input data and sends a portion of it along wires 125 and a portion to a wireless transceiver (TRx) 122. The TRx 122 is connected to an antenna 123 that transmits the received signal from the TRx 122. The SerDes 121, TRX 122, and antenna 123 may also operate in the opposite direction were the data flows from the hybrid connector 130 to the first device 120. The first device has power lines 126 that provide power to the SerDes 121 and the TRx 122 as well as passing power onto the cable 160. The second device has a similar structure and operation with SerDes 151, wires 155, TRx 152, antenna 153, and power lines 156.

The cable 160 includes data lines 164, power lines 166, first hybrid connector 130, and second hybrid connector 150. The first hybrid connector has power lines 136 that transfer power between the power lines 126 of the first device and the powerlines 166 of the cable 160. The power lines 136 also provide power to the TRx 132 and the SerDes 131. The first hybrid connector 130 also has data lines 135 that are galvanically connected to the data lines 125 so that data may be transmitted and received between the first hybrid connector 130 and the first device 110 using a wired connection. Further, the TRx 132 is connected to antenna 133 which allows for a wireless connection to the first device 120 via the TRx 122 and antenna 123 of the first device. The SerDes 131 of the first hybrid connector is connected to the wires 164 and transmits and receives data from the wires 164. Further, the SerDes 131 is connected the TXr 132 and the wire lines 135 so that data for transmission and reception is split between the SerDes 131 and the TXr 132. The second hybrid connector 140 and is similar elements 141-146 operate in the same manner.

The system in FIG. 3 shows system where the wired connections are supplemented by a wireless connection to increase the throughput of the connection between the first device 120 and the second device 150 via cable 160. The addition of the wireless link may be done in a way that leaves the hybrid connector compatible with existing connectors, for example, USB Type-A, USB Type-A superspeed, and USB-C. Further, as will be discussed further below, the hybrid connector may be configured to be insensitive to connector orientation leading to improved ease of use.

Figure 4:
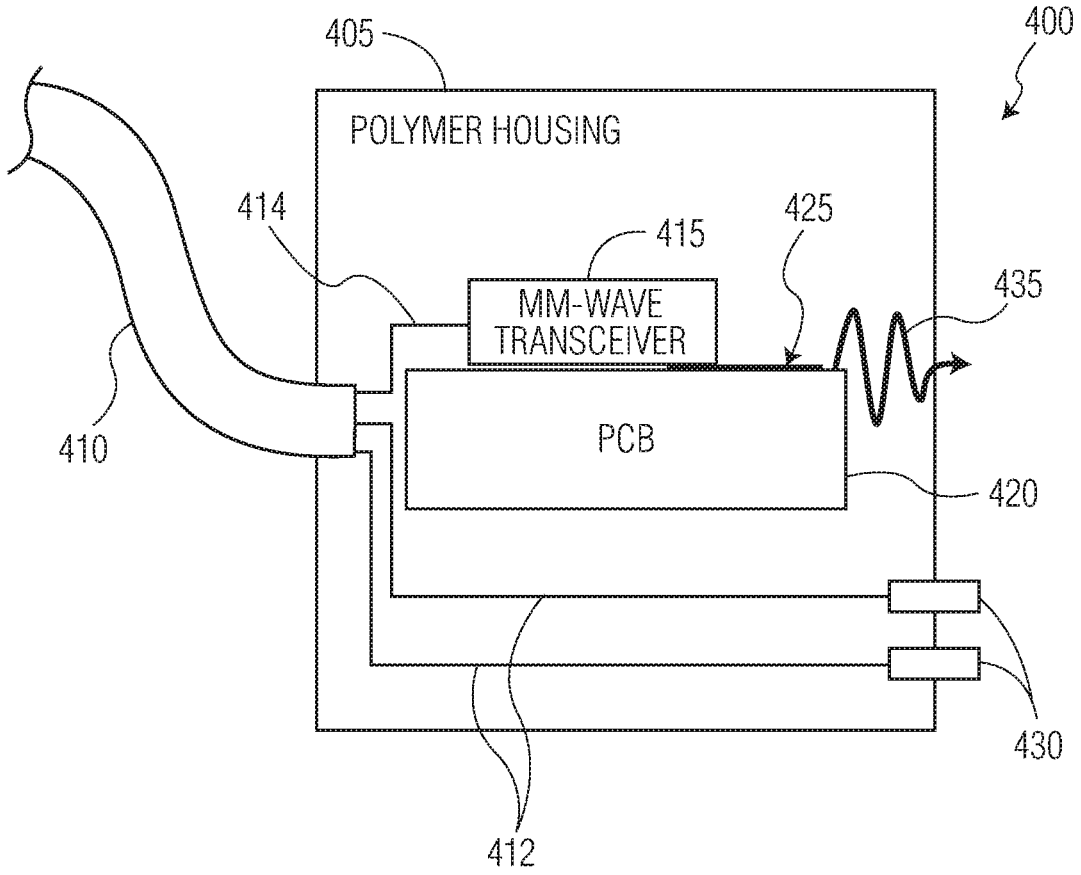
FIG. 4 shows a simplified connector where the galvanic connections are only used for power delivery and all data is exchanged though the short range wireless connection.

FIG. 4 shows a simplified connector 400 where the galvanic connections are only used for power delivery and all data is exchanged though the short range wireless connection. The connector 400 includes a housing 405 that is connected to the cable 410. The housing 405 includes power wires connected 412 to the cable 410 and the power pins 430. The housing 405 further includes a printed circuit board (PCB) 420 that includes the millimeter wave TRx 415 and antenna 425. The TRx 415 is connected to data wires 414 carrying data to be transmitted/received. The antenna 425 transmits/receives a millimeter wave signal 435. The embodiment of FIG. 4 may, for example, be backwards compatible with MagSafe connectors from Apple Inc.

State of the art short range millimeter wave links demonstrate link speeds of 13 Gbps up to 20 Gbps. Because of the high SNR that is achievable with the hybrid connector due to the short propagation distances and sufficient transmit power, such link speeds will be possible in this application. To reach data rates beyond 50 Gbps multiple millimeter wave channels will be required in a single connector. This may be achieved by integrating multiple transmitters and receivers inside a single connector as well as in the complementary receptacle.

Figure 5A:
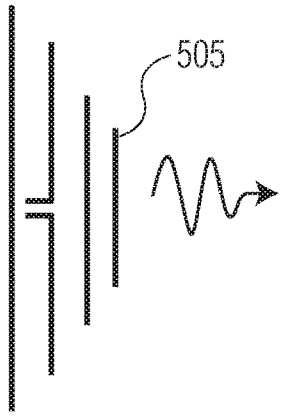
FIGS. 5A and 5B illustrate a Yagi-Uda antenna or a Vivaldi antenna respectively.
Figure 5B:
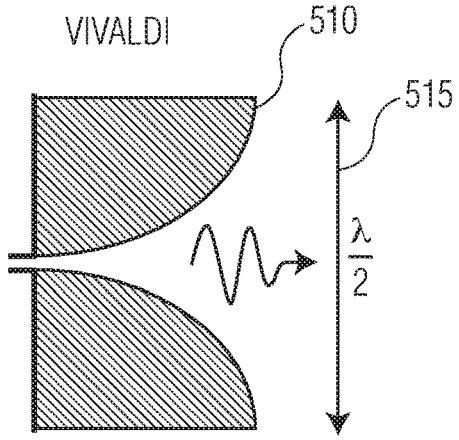

Several antenna configurations are possible. FIGS. 5A and 5B illustrate a Yagi-Uda antenna 505 or a Vivaldi antenna 510 respectively. The Yagi-Uda antenna 505 and the Vivaldi antenna 510 are side-coupled antennas so they occupy little front-facing area on the hybrid connector. The width of such antenna measures half a wavelength, which is approximately 1 mm 515 at millimeter wave frequencies. Other types of antennas may be used as well as long as they are able to fit in the space available on the connector, for example a patch antenna or dipole antenna that is sufficiently small may also be used. Furthermore, polarization diversity may be exploited to re-use frequency bands without causing crosstalk to other channels.

Figure 6:
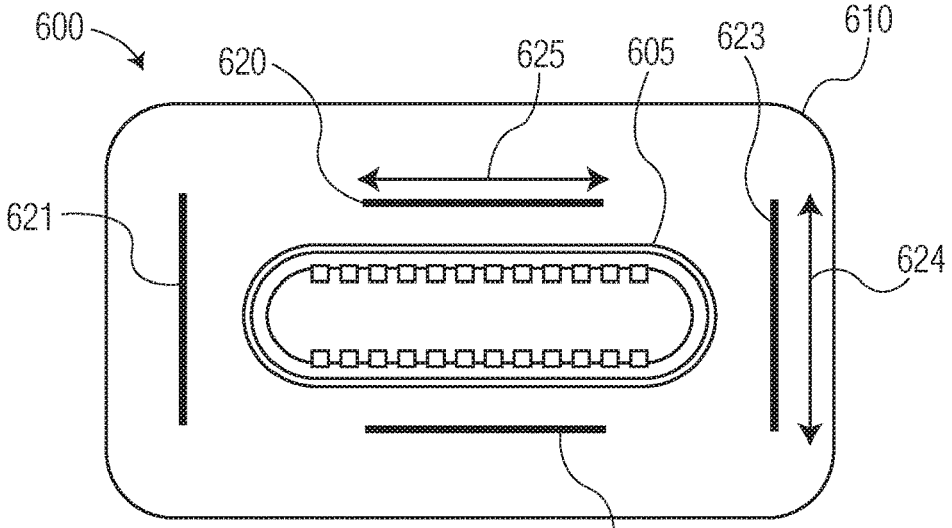
FIG. 6 illustrates an embodiment of a hybrid connector incorporating side-coupled antennas supporting horizontal and vertical polarization.

FIG. 6 illustrates an embodiment of a hybrid connector incorporating side-coupled antennas supporting horizontal and vertical polarization. The hybrid connector 600 includes a housing 610, wired connector 605, and antennas 621, 622, 623, and 624. The wired connector 605 is shown as USB-C connector, but other connectors are possible. The antennas 620 and 622 are substantially orthogonal to antennas 621 and 624, and hence they have different polarizations. This means that the same frequency band used on either antenna 620 or antenna 622 may also be used on either antenna 621 or antenna 623 without interference. This allows for increased data bandwidth to be used. It also allows for TRx's (not shown) covering the same frequency band to be used with both antennas, driving down the number of different parts needed to for the hybrid connector. In another embodiment of the hybrid connector 600, the hybrid connector 600 may remain flippable because the hybrid connector 600 may only use the antenna 620 on the top and the antenna 621 to the left that match a receptacle on a device. Then if the connector is flipped, the opposite antennas 622 and 623 may be used instead. It is further noted that the antennas 620-623 are about 1 mm in length 624 and 625.

Figure 7:
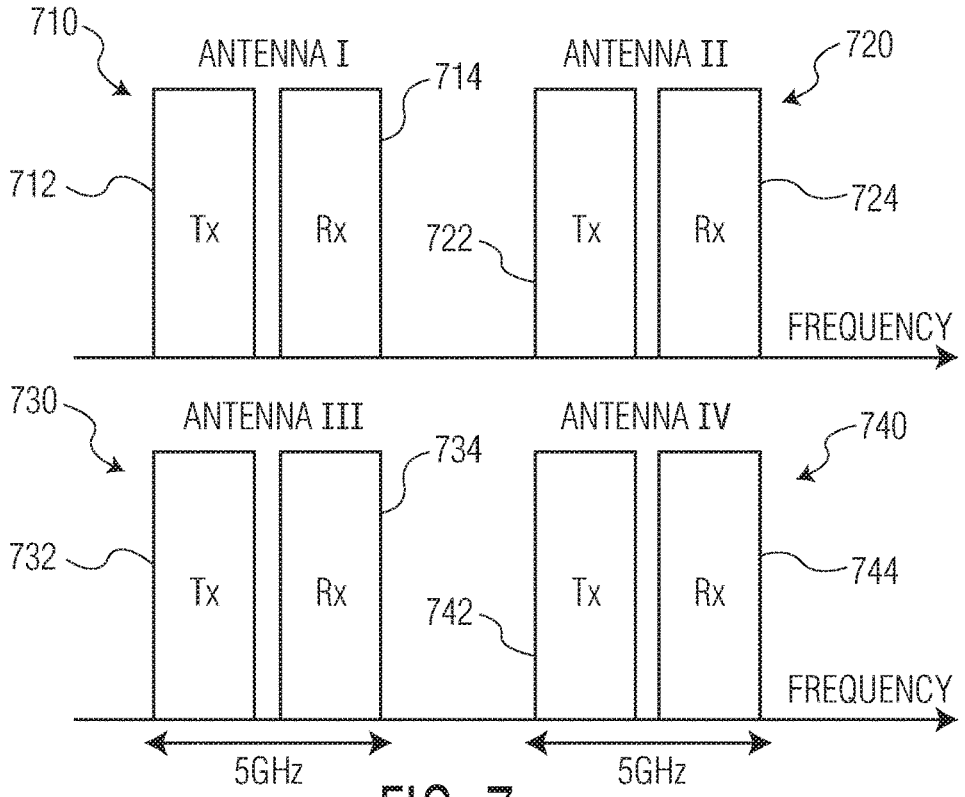
FIG. 7 illustrates an example of a frequency allocation plan exploiting frequency and polarization diversity.

FIG. 7 illustrates an example of a frequency allocation plan exploiting frequency and polarization diversity. The transmit and receive frequency bands are shown for four different antennas 710, 720, 730, and 740. First and second antennas 710 and 720 have transmit bandwidths 712 and 722 respectively and receive bandwidths 714 and 724 respectively. First and second antennas 710 and 720 have the same polarization. Third and fourth antennas 730 and 740 have transmit bandwidths 732 and 742 respectively and receive bandwidths 734 and 744 respectively. Third and fourth antennas 730 and 740 have the same polarization, which polarization is substantially orthogonal to the polarization of the first and second antennas 710 and 720. Accordingly, the bandwidths for the first antenna 710 may be the same as the bandwidths for the third antenna 730. Likewise, the bandwidths for the second antenna 720 may be the same as the bandwidths for the fourth antenna 740. Such an arrangement allows for four transmit and four receive channels. If each channel can support 10-15 Gb/s, then the total bandwidth of the connector using the wireless connection may be 40 to 60 Gb/s in each direction. This may be in addition to the bandwidth available using the wired galvanic connections.

Figure 8:
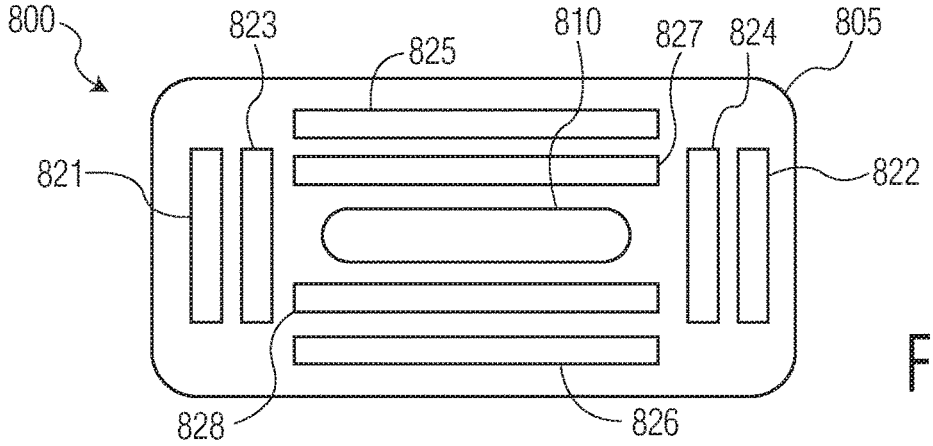
FIG. 8 illustrates a first embodiment of a flippable connector supporting the frequency allocation plan of FIG. 7.
Figure 9:
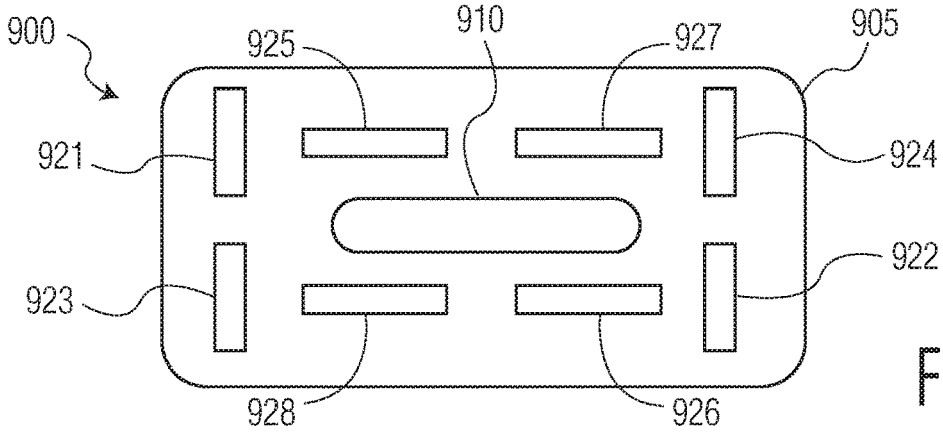
FIG. 9 illustrates a second embodiment of a flippable connector supporting the frequency allocation plan of FIG. 7.

FIG. 8 illustrates a first embodiment of a flippable hybrid connector 800 supporting the frequency allocation plan of FIG. 7. FIG. 9 illustrates a second embodiment of a flippable hybrid connector 900 supporting the frequency allocation plan of FIG. 7.

In FIG. 8, eight antennas 821-828 in are shown in pairs surround the connector 810 where one antenna in the pair is closer to the connector 810 and the other is closer to an outer edge of the housing 805. At any given time half of the connectors would be used. For example, in the current orientation antennas 821, 823, 835, and 827 may be used to implement the wireless connection between the connector 825 and a receptacle (not shown). If the connector 800 is flipped then antennas 822, 824, 836, and 828 may be used to implement the wireless connection between the connector 825 and a receptacle (not shown). Further, antennas 821, 823, 835, and 827 are substantially orthogonal to antennas 822, 824, 836, and 828 so their polarizations are substantially orthogonal to one another meaning that frequency bands may be reused between the two sets of antennas. This results in a connector that may be flippable while adding significant additional bandwidth to the cable while maintaining compatibility with USB-C cables.

In FIG. 9, eight antennas 921-928 in are shown in pairs surround the connector 910 where each antenna pair are substantially colinear. At any given time half of the antennas would be used. For example, in the current orientation antennas 921, 923, 925, and 927 may be used to implement the wireless connection between the connector 925 and a receptacle (not shown). If the connector 900 is flipped then antennas 922, 924, 926, and 928 may be used to implement the wireless connection between the connector 925 and a receptacle (not shown). Further, antennas 921, 923, 924, and 922 are substantially orthogonal to antennas 925, 927, 926, and 928 so their polarizations are substantially orthogonal to one another meaning that frequency bands may be reused between the two sets of antennas. This results in a connector that may be flippable while adding significant additional bandwidth to the cable while maintaining compatibility with USB-C cables.

Receptacles on devices connected to the data cable may have antenna layouts that are complementary to those shown for the hybrid connectors 800 and 900. Further, in alternative embodiments of receptacles corresponding to hybrid connectors 800 and 900, only half of the antennas may be present, for example, only those corresponding to 821, 823, 825, and 827 for hybrid connector 800, and 921, 923, 925, and 927 for hybrid connector 900. Such an arrangement still allows for the hybrid connectors to be flippable while reducing the number of antennas need in the receptacle.

In alternative embodiments of hybrid connectors 800 and 900, only half of the antennas may be present, for example 821, 823, 825, and 827 for hybrid connector 800, and 921, 923, 925, and 927 for hybrid connector 900. The receptacle, in this case may then have the full eight antennas in complementary configures to those shown for hybrid connectors 800 and 900 in FIGS. 8 and 9 respectively. In this case situation, the hybrid connector is less complex and also there is less space on connector making the connector less crowded. Further, the receptacle typically resides in a larger device, (e.g., laptop, disk drive, display, etc.) where space is as less of a premium. Such an arrangement still allows for the hybrid connectors to be flippable.

In another embodiment, the hybrid connector may be made flippable by allowing the TRx's to be connected to multiple antenna's using switches. Then the TRx channels may be paired by sending/receiving interrogation signals upon connection. So for the examples using 8 antennas, 8 channels may be implemented where each TRx is connected to two different antennas and the TRX selects the proper antenna based upon sending/receiving interrogation signals.

In another embodiment, data may also be modulated onto the power signals in order to increase the bandwidth of the hybrid connection. Any of the TRx's may be used to add this modulation to the power lines.

The hybrid connector embodiments described herein will enable a connector supporting high data rates allowing for a connector with: a simple mechanical build-up of connector; a small number of pins that allow for small size and mating symmetry; that is robust and insensitive to dust and dirt; and compatibility to existing port and connector layouts.

Further while the example of UBB-C connectors and USB connectors in general are described in the embodiments above, other types of connectors may be used to implement the various embodiments of hybrid connectors described herein.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A hybrid connector for a data cable, comprising:

a galvanic connector having a plurality of connectors configured to make a galvanic connection with a plurality of connectors in a receptacle wherein a first portion of the plurality connectors are power connections and a second portion of the plurality of connectors are data connections;

a plurality of millimeter wave wireless transmitter/receivers (TRx) configured to transmit/receive data from/to the hybrid connector; and a plurality of millimeter wave antennas surrounding the galvanic connector, wherein each antenna of the plurality of millimeter wave antennas is connected to one of the plurality of millimeter wave TRx's and the plurality of millimeter wave antennas are configured to transmit/receive millimeter wave data signals; and wherein first antennas of the plurality of millimeter wave antennas operate when the hybrid connector is in a first orientation and second antennas of the plurality of millimeter wave antennas operate when the hybrid connector is in a second orientation.

2. The hybrid connector of claim 1, wherein the plurality of millimeter wave antennas are configured so that the hybrid connector is flippable between the first orientation and the second orientation.

3. The hybrid connector of claim 1, wherein half of the first antennas of the plurality of millimeter wave antennas have a polarization that is substantially orthogonal to the polarization of the second antennas of the plurality of millimeter wave antennas.

4. The hybrid connector of claim 1, wherein the plurality of millimeter wave antennas includes eight antennas and four millimeter wave TRx's.

5. The hybrid connector of claim 3, wherein the eight millimeter wave antennas are configured in pairs surrounding the galvanic connector.

6. The hybrid connector of claim 4, wherein one antenna of each of the antenna pairs is closer to the galvanic connector and the other antenna of each of the antenna pairs is farther from the galvanic connector.

7. The hybrid connector of claim 4, wherein the antennas of each of the antenna pairs are substantially colinear.

8. The hybrid connector of claim 1, wherein the plurality of antennas are side-coupled antennas.

9. The hybrid connector of claim 1, wherein one of the plurality of antennas is one of a Yagi-Uda antenna and a Vivaldi antenna.

10. The hybrid connector of claim 1, wherein the galvanic connector is a USB-C connector.

11. The hybrid connector of claim 1, wherein each of the plurality of TRx's are connected to two of the plurality of millimeter wave antennas via a plurality of switches so that the hybrid connector is flippable between the first orientation and the second orientation.

12. The hybrid connector of claim 1, wherein one of the plurality of TRx's is configured to modulate a data signal onto the power connections.

13. The hybrid connector of claim 1, wherein the first antennas of the plurality of millimeter wave antennas have a polarization that is substantially orthogonal to the polarity of the second antennas of the plurality of millimeter wave antennas; and wherein the first antennas of the plurality of millimeter wave antennas and the second antennas of the plurality of millimeter wave antennas operate in overlapping frequency bands.

14. The hybrid connector of claim 13, wherein the plurality of millimeter wave antennas surrounding the galvanic connector are arranged symmetric to a longitudinal axis and to a latitudinal axis of the hybrid connector.

15. A data cable, comprising:

a first hybrid connector;

a second hybrid connector; and a plurality of wires connecting the first and second hybrid connectors, wherein each of the first and second hybrid connectors comprise:

a galvanic connector having a plurality of connectors configured to make a galvanic connection with a plurality of connectors in a receptacle wherein a first portion of the plurality connectors are power connections and a second portion of the plurality of connectors are data connections;

a plurality of millimeter wave wireless transmitter/receivers (TRx) configured to transmit/receive data from/to the hybrid connector; and a plurality of millimeter wave antennas surrounding the galvanic connector, wherein each antenna of the plurality of millimeter wave antennas is connected to one of the plurality of millimeter wave TRx's and the plurality of millimeter wave antennas are configured to transmit/receive millimeter wave data signals; and wherein first antennas of the plurality of millimeter wave antennas operate when the first and second hybrid connectors are in a first orientation and second antennas of the plurality of millimeter wave antennas operate when the first and second hybrid connector are in a second orientation.

16. The data cable of claim 15, wherein the plurality of millimeter wave antennas for each of the first and second hybrid connectors are configured so that the first and second hybrid connectors are flippable between the first orientation and the second orientation.

17. The data cable of claim 15, wherein the first antennas of the plurality of millimeter wave antennas for each of the first and second hybrid connectors have a polarization that is substantially orthogonal to the polarization of the second antennas of the plurality of millimeter wave antennas.

18. The data cable of claim 15, wherein the plurality of millimeter wave antennas for each of the first and second hybrid connectors includes eight antennas and four millimeter wave TRx's.

19. The data cable of claim 15, wherein the eight millimeter wave antennas for each of the first and second hybrid connectors are configured in pairs surrounding the galvanic connector.

20. The data cable of claim 15, wherein the plurality of antennas are side-coupled antennas.

21. The data cable of claim 15, wherein one of the plurality of antennas is one of a Yagi-Uda antenna and a Vivaldi antenna.

22. The hybrid connector of claim 15, wherein the galvanic connector for each of the first and second hybrid connectors is a USB-C connector.

23. A hybrid receptacle configured to receive a hybrid connector of a data cable, comprising:

a galvanic connector having a plurality of connectors configured to make a galvanic connection with a plurality of connectors in the hybrid connector wherein a first portion of the plurality connectors are power connections and a second portion of the plurality of connectors are data connections;

a plurality of millimeter wave wireless transmitter/receivers (TRx) configured to transmit/receive data from/to the hybrid receptacle; and a plurality of millimeter wave antennas surrounding the galvanic connector, wherein each antenna of the plurality of millimeter wave antennas is connected to one of the plurality of millimeter wave TRx's and the plurality of millimeter wave antennas are configured to transmit/receive millimeter wave data signals; and wherein first antennas of the plurality of millimeter wave antennas operate when the hybrid connector is in a first orientation and second antennas of the plurality of millimeter wave antennas operate when the hybrid connector is in a second orientation.

24. The hybrid receptacle of claim 23, wherein the plurality of millimeter wave antennas are configured so that the hybrid receptacle is flippable.

25. The hybrid receptacle of claim 23, wherein the first antennas of the plurality of millimeter wave antennas have a polarization that is substantially orthogonal to the polarization of the second antennas of the plurality of millimeter wave antennas.

26. The hybrid receptacle of claim 23, wherein the plurality of millimeter wave antennas includes eight antennas and four millimeter wave TRx's.

27. The hybrid receptacle of claim 26, wherein the eight millimeter wave antennas are configured in pairs surrounding the galvanic connector.

28. The hybrid receptacle of claim 23, wherein the plurality of antennas are side-coupled antennas.

29. The hybrid connector of claim 23, wherein one of the plurality of antennas is one of a Yagi-Uda antenna and a Vivaldi antenna.

30. The hybrid connector of claim 23, wherein the galvanic connector is a USB-C connector.

31. The hybrid connector of claim 23, wherein each of the plurality of TRx's are connected to two of the plurality of millimeter wave antennas via a plurality of switches so that the hybrid connector is flippable between the first orientation and the second orientation.

32. The hybrid connector of claim 23, wherein one of the plurality of TRx's is configured to modulate a data signal onto the power connections.

* * * * *